United States Patent [19]

Pan

[11] Patent Number: 5,016,288

[45] Date of Patent: May 21, 1991

[54] SCARF

[76] Inventor: Peter Pan, 15F-3, No. 127, Fu-Hsin S. Road, Taipei, Taiwan

[21] Appl. No.: 577,533

[22] Filed: Sep. 5, 1990

[51] Int. Cl.[5] ..... A41D 23/00

[52] U.S. Cl. ..... 2/207; 2/243 R

[58] Field of Search ..... 2/207, 206, 208, 243 R, 2/243 A; D2/500, 502

[56] References Cited

U.S. PATENT DOCUMENTS

| | | | |
|---|---|---|---|
| 2,183,998 | 3/1938 | Thorman | 2/207 |
| 2,741,773 | 4/1956 | Wolfe | 2/207 |
| 3,286,276 | 11/1966 | Calisch | 2/207 |

FOREIGN PATENT DOCUMENTS

| | | | |
|---|---|---|---|
| 12067 | 3/1892 | United Kingdom | 2/207 |
| 553042 | 5/1942 | United Kingdom | 2/207 |

*Primary Examiner*—Werner H. Schroeder
*Assistant Examiner*—Amy Brooke Vanatta
*Attorney, Agent, or Firm*—Morton J. Rosenberg; David I. Klein

[57] ABSTRACT

This invention relates to a scarf and in particular to one including a middle flap and two side flaps of the same size and different patterns whereby the flaps may be folded in different ways thereby providing the scarf with different patterns.

2 Claims, 3 Drawing Sheets

SCARF

BACKGROUND OF THE INVENTION

It is found that the prior art scarf has a pattern only so that one must prepare several scarfs if desired to adapt the scarf with various dresses. Hence, there is a need for a scarf which may present different patterns so as to match various dresses.

Therefore, it is another object of the present invention to provide a scarf which may obviate and mitigate the above-mentioned drawback.

SUMMARY OF THE INVENTION

This invention relates to an improved scarf.

It is the primary object of the present invention to provide a scarf which may be folded in different ways to present different patterns.

It is another object of the present invention to provide a scarf which may be used as a number of scarfs.

It is still another object of the present invention to provide a scarf which is economic to produce.

It is still another object of the present invention to provide a scarf which can be easily changed in pattern.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
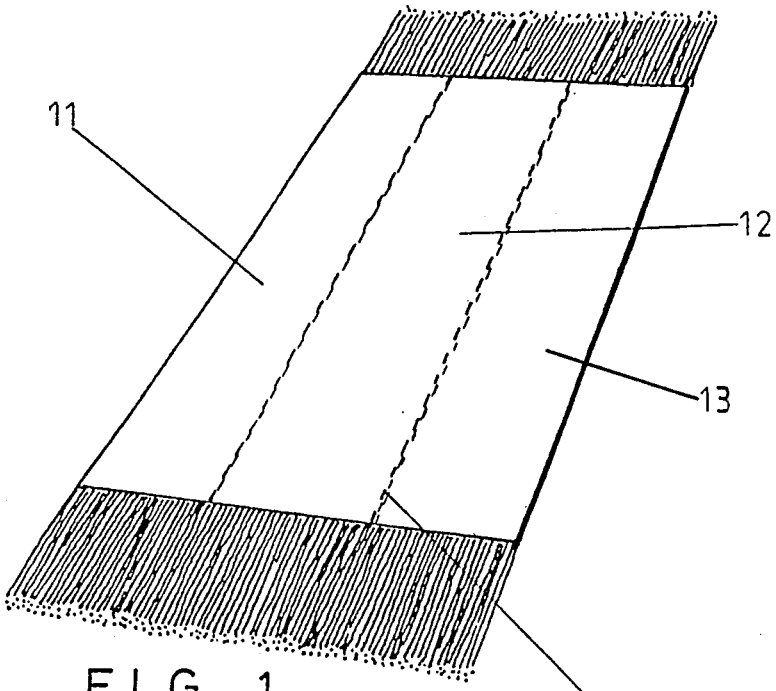
FIG. 1 shows a scarf according to the present invention.
Figure 5:
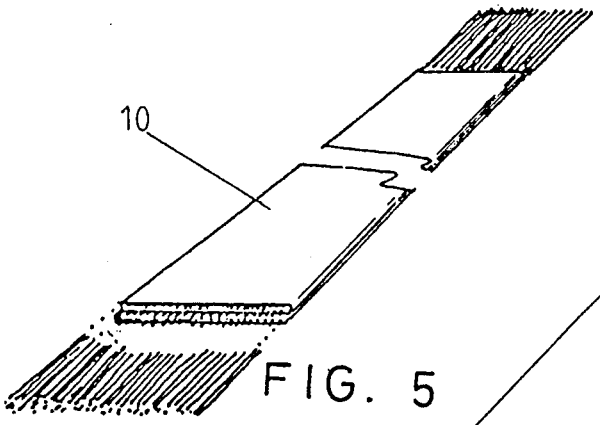
FIG. 5 shows an application of the scarf.
Figure 2:
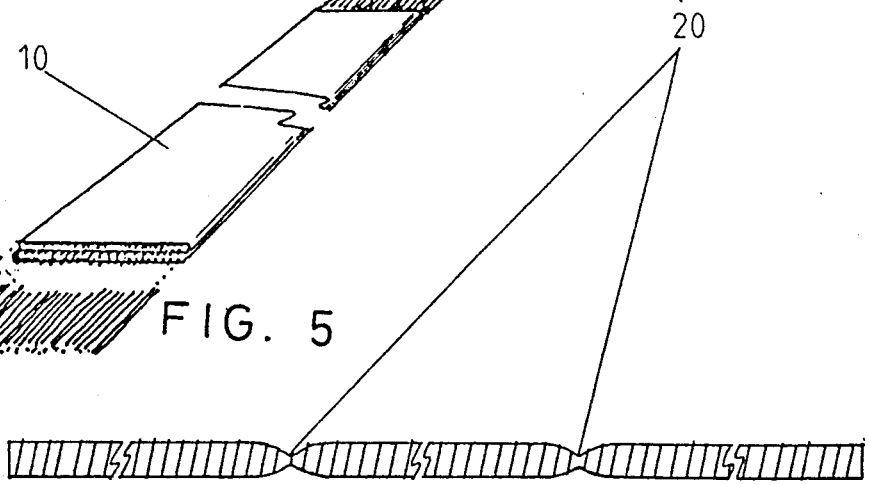
FIG. 2 is a sectional view of the scarf.
Figure 3:
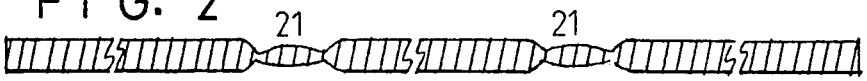
FIG. 3 is a sectional view of a scarf according to another preferred embodiment of the present invention.
Figure 4:
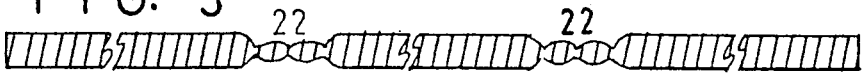
FIG. 4 is a sectional view of a scarf according to the third preferred embodiment of the present invention.

With reference to the drawings and in particular to FIG. 1 thereof, the scarf 10 according to the present invention mainly comprises three flaps 11, 12 and 13 which are of some size and different patterns and connected together via a seam 20. The flaps 11, 12 and 13 may be conveniently made of opaque cloth or translucent cloth. If the flaps are made of opaque silk and have different patterns, the flaps may be folded in six ways. In case the flaps are made of translucent silk and have different patterns, the flaps may be folded in many ways. It is noted that the thickness of the flaps is thin enough so that the scarf will not be thicker than the prior art. Regarding the seam 20, it can be modified into the seam 21 or 22 (see FIGS. 3 and 4) as desired.

Figure 6:
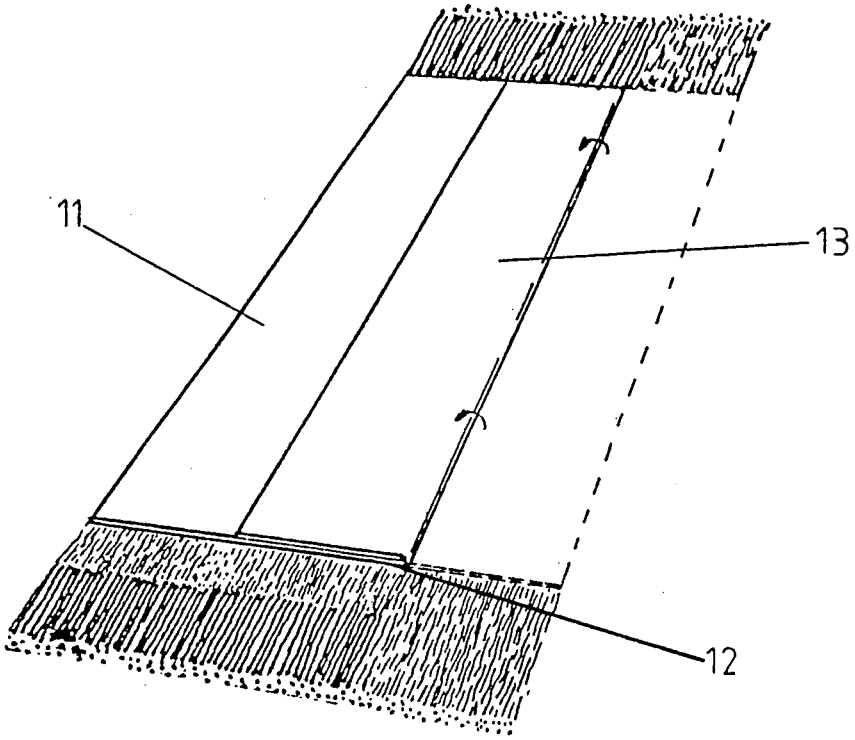
FIGS. 6 and 7 show the folding of the scarf.
Figure 7:
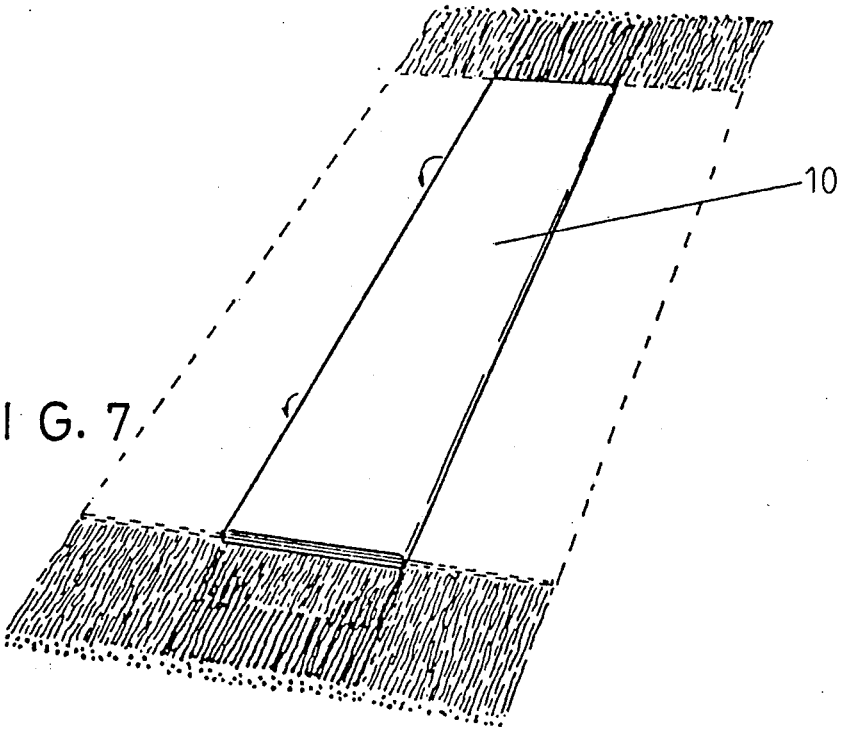

FIGS. 6 and 7 show the way to fold the scarf. As illustrated, the scarf may appear in different patterns simply by changing the order of folding the flaps.

Figure 8:
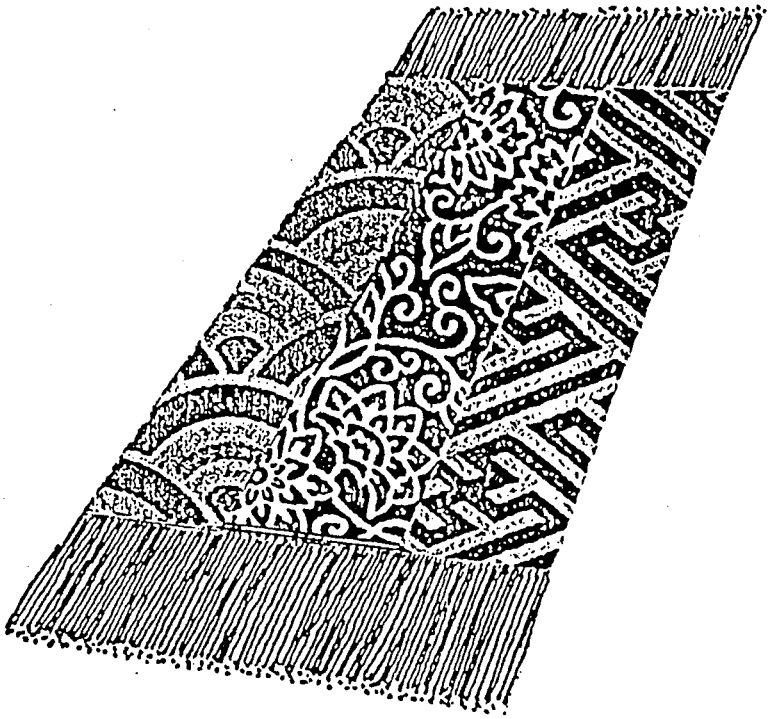
FIG. 8 shows the patterns on one side of the scarf.
Figure 9:
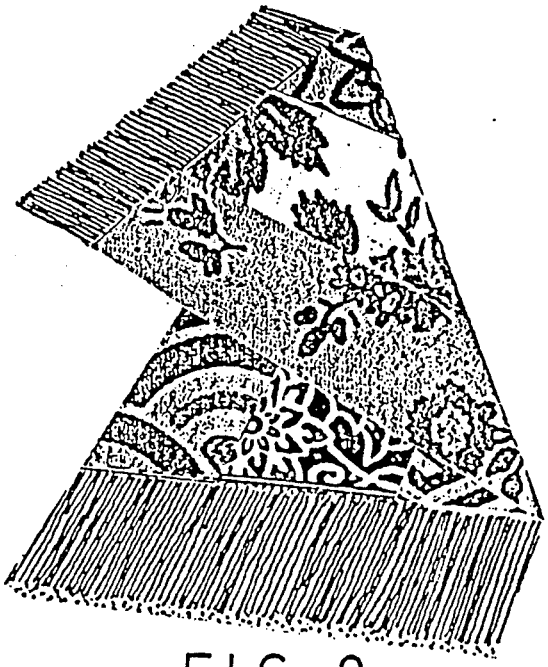
FIG. 9 shows the patterns on the other side of the scarf.

FIG. 8 shows the patterns on one side of the scarf while FIG. 9 shows the patterns on the other side of the scarf.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A scarf comprising:

a middle flap having a pattern;

a first side flap connected to one side of said middle flap, having same size as said middle flap and a pattern different from that of said middle flap; and a second side flap connected to the other side of said middle flap, having same size as said middle flap and a pattern different from that of said middle flap;

whereby said middle flap, first flap and second flap may be foled in different ways thereby providing said scarf with different patterns.

2. The scarf as claimed in claim 1, wherein said flaps may be made of opaque or translucent cloth.

* * * * *